United States Patent [19]

Zielinski et al.

[11] Patent Number: 4,950,182

[45] Date of Patent: Aug. 21, 1990

[54] SECONDARY LOCK MECHANISM FOR AN ENVIRONMENTALLY SEALED CABLE ASSEMBLY

[75] Inventors: Thomas E. Zielinski, Saint Clair; Paul W. Geyer, Rochester, both of Mich.

[73] Assignee: Chrysler Corporation, Highland Park, Mich.

[21] Appl. No.: 383,845

[22] Filed: Jul. 24, 1989

[51] Int. Cl.[5] ..... H01R 13/436

[52] U.S. Cl. ..... 439/595; 439/752

[58] Field of Search ..... 439/595, 752, 744

[56] References Cited

U.S. PATENT DOCUMENTS

| | | | |
|---|---|---|---|
| 4,479,691 | 10/1984 | Smith, Jr. | 439/595 |
| 4,557,542 | 12/1985 | Coller et al. | 439/595 |
| 4,565,416 | 1/1986 | Rudy et al. | 439/592 |
| 4,749,372 | 6/1988 | Betsui | 439/587 |
| 4,787,864 | 11/1988 | Hunt, III | 439/595 |
| 4,806,123 | 2/1989 | Konishi et al. | 439/595 |
| 4,820,198 | 4/1989 | Lulko et al. | 439/595 |
| 4,832,614 | 5/1989 | Jenkins | 439/595 |

*Primary Examiner*—Gary F. Paumen

*Attorney, Agent, or Firm*—Wendell K. Fredericks

[57] ABSTRACT

A terminal secondary lock bar effects locking of keepers in circular grooves of terminals disposed in rows above and below a lock bar receiving cavity arranged in an interior location within the housing of a plug and a socket of an in-line environmentally sealed cable assembly. The lock bar has two outer laterally directed semi-triangularly shaped fingers and at least one rectangular shaped finger disposed therebetween. The outer fingers are flexed inwardly upon insertion until a region of the cavity provides a lock reaction to the ends of the fingers which flex outwardly into the lock region of the cavity. The outer fingers are also flexed inwardly upon removal of the lock bar from the cavity.

6 Claims, 2 Drawing Sheets

SECONDARY LOCK MECHANISM FOR AN ENVIRONMENTALLY SEALED CABLE ASSEMBLY

BACKGROUND OF THE INVENTION

1. Field of the Invention

This invention relates to cable assemblies and more particularly in a preferred embodiment to environmentally sealed cable assemblies for connecting of multiple cables to components having plug and socket connectors. The plug and socket connectors include female and male terminals mechanically locked in terminal receiving channels within molded housings of the connectors in a novel manner to prevent the terminals from being forcefully removed.

2. Description of the Prior Art

Prior art assemblies include means of locking terminals in terminal receiving channels of connector housings. Structure in the housings such as resilient material locking fingers with a nib at one end which snaps into a locking groove in the shaft of each inserted terminal are used to hold terminals in place, providing a primary means for retaining the terminals within the housing. Such an arrangement could not be expected to prevent forceful removable of the terminals from the housing since slightly higher than normal force upon the cables often would be sufficient to cause the terminals to deflect the fingers removing the nibs from the grooves.

In addition to having grooved terminals and resilient material locking fingers for primary retention purposes, secondary locking means have also been used to provide an additional lock for keeping the terminals in place during handling and use. One such secondary locking means for sealed plugs and sockets have included a wedged lock bar that is driven into the plug housing behind the primary locking fingers to frictionally hold in place the fingers so that slightly higher than normal force would not remove the terminals from the housing.

Such a lock bar provides adequate secondary locking, but during disassembly of the plug or socket, it may be awkward to remove the wedge lock bar without damaging the pin terminals and the housing. This locking means, which is forced into place, is usually adequate for one or two cables per connector but is inadequate for multiple cable connecting.

To provide a locking bar suitable for use as a secondary locking means in sealed assemblies housing multiple connections, it is desirable to provide a secondary locking means that will achieve locking of the primary locking mechanism in the interior of the housing since no openings in the housing walls are allowed due to the nature of sealed connectors. Also, it is desirable to provide a lock bar that can be readily removed from the housing without damage to the housing, the terminals or the primary locking mechanism.

To obtain the above-mentioned objectives, a search for various other means to enhance the locking characteristics of the secondary lock bar was initiated. This search resulted in improved secondary locking devices of the present invention.

SUMMARY OF THE INVENTION

The present invention concerns cable assemblies having connectors for connecting multiple cables or wires to components or other cables or wires. The sockets and plugs both have housings with terminal receiving channels molded therewithin for receiving female and male terminals respectively. A locking groove encircles a chosen region of the shaft of each terminal. A resilient material locking finger disposed in each receiving channel engages the groove when a terminal is inserted, providing primary locking of the terminals in the housing. No portion of the sidewalls of the housing for both the sockets and plugs include apertures since the assembly must form an environmentally sealed unit. Not only does the locking bar provide secondary locking, which fixedly locks the resilient material locking fingers in the locking grooves of the terminals, the secondary locking bar of this invention has a plurality of upright struts having concave-shaped distal ends which encircle an under portion of the periphery of the pins and mates with a plurality of arc shaped, pin receiving channels in a complimentary fashion so as to prevent wobbly movement of the terminals when the sockets and plugs are joined.

DETAILED DESCRIPTION OF A PREFERRED EMBODIMENT

Figures 1, 2, 3:
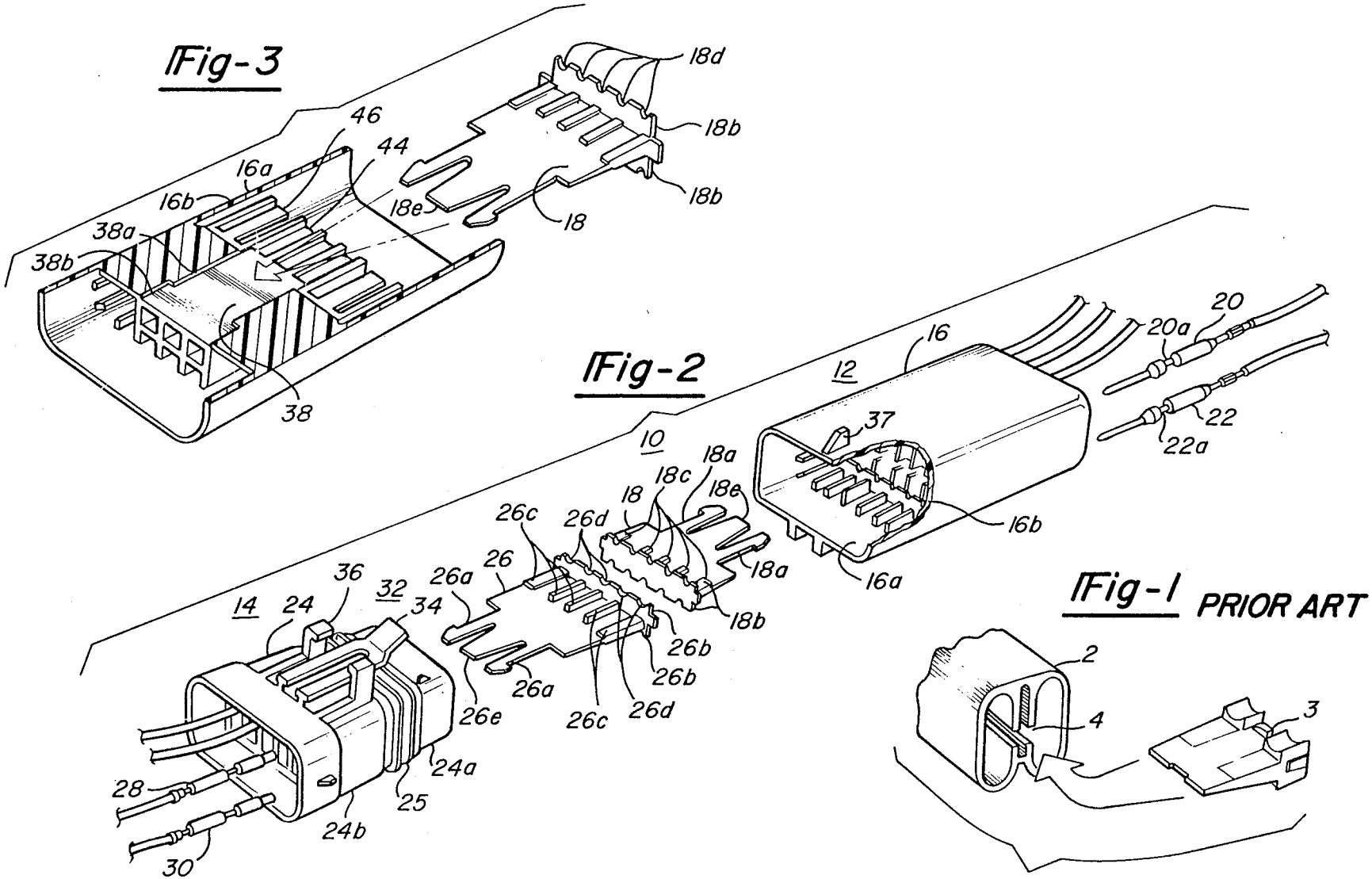
Fig-1 PRIOR ART
FIG. 1 is a perspective view of an in-line plug of a cable assembly illustrative of a prior art wedge-type secondary lock bar.
FIG. 2 is a perspective view of an in-line plug and socket cable assembly constructed in accordance with the present invention.
FIG. 3 is a sectioned top view of the in-line plug of this invention illustrative of an interior lock bar receiving cavity.

Referring now to FIG. 1, there is shown a prior art in-line connector 2 that employs a wedge-shaped lock bar 3. Two tiers of a pair of terminals (not shown) with wires attached are inserted into channels in the connector 2. These terminals have a grooved slot encircling a chosen region. A resilient material locking finger (not shown) disposed in each channel engages the slot of each terminal when a terminal is inserted providing primary locking of the terminals in the connector. Wedge-shaped lock bar 3 is frictionally forced in a slot 4 against a back face of the resilient fingers, the top of the bar being used to engage the fingers for the top tier of terminals and the underside of the bar being used to engage the fingers for the lower tier of terminals. Wedge-shaped lock 3 is installed in connector 2 during assembly and is not intended to be repeatedly removed for disassembly. Hence, too many attempts to disassemble the plug would probably result in destroying the frictional locking feature of the wedge.

Referring now to FIGS. 2–6, there is shown in FIG. 2 an in-line cable assembly 10 that includes an in-line plug 12 and an in-line socket 14.

Plug 12 includes a molded dielectric material housing 16, a separately molded lock bar 18, and a plurality of small male terminals 20 with wires attached and at least a pair of large male terminals 22 with wires attached. Housing 16 is comprised of two integrally molded dielectric material sections, a front undivided chamber 16*a* for receiving the socket 14 and a rear chamber cavity 16*b* for housing the terminals.

Socket 14 includes a molded housing 24, secondary lock bar 26 and a plurality of small female terminals 28 with wires attached and at least a pair of large female terminals 30 with wires attached.

Both lock bars 18 and 26 include a pair of outer, laterally-directed, triangular shaped, resilient fingers 18*a* and 26*a* respectively at a front region and a pair of oppositely directed up-right struts 18*b* and 26*b* respectively at a rear end of each bar. All the struts have nesting distal ends 18*d* and 26*d* respectively that engage an underside of a front mounting surface of the shaft of each terminal mounted in the housings. Below each distal end of the struts, a series of pressure pads 18*c* and 26*c*, respectively, are disposed. Each pad exerts pressure against an end of a resilient locking finger disposed within a terminal receiving channel of the housings when the lock bar is inserted in the housing. The lock bars have, in addition to resilient fingers, at least one rectangular finger 18*d* and 26*d* disposed between the resilient fingers 18*e* and 26*e* respectively.

Housing 24 has a front exterior region 24*a* upon which an environmental packing seal 25 mounts and a rear exterior region 24*b* that contains a resilient latch 34 and a pair of over-stress brackets 36 of a lock 32 used to lock socket 14 to plug 12. The housing 16 of plug 12 carries a latch post 37 which engages latch 34 of lock 32.

Figure 6:
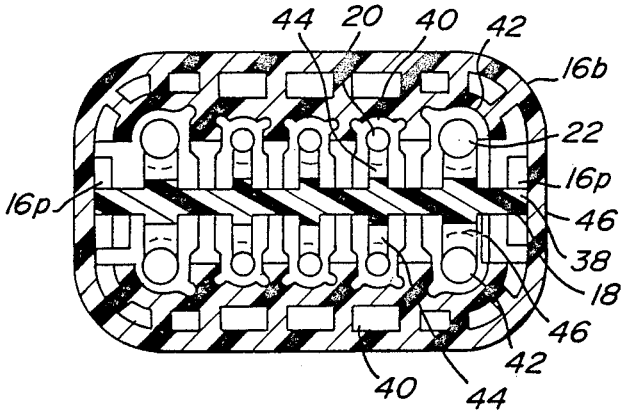
FIG. 6 is a front elevated view of the in-line plug of FIG. 5 taken along the lines 6—6.

The chamber 16*b* of plug 12 as depicted in FIG. 6 contains, within a central region, a lock bar receiving cavity 38 for receiving lock bar 18. Lock bar receiving cavity 38 is not open peripherally to the exterior of the plug. Cavity 38 extends substantially the length of chamber 16*b* as shown in FIGS. 2 and 4.

Above and below cavity 38, chamber 16*b* contains small and large terminal receiving channels 40 and 42 respectively, Small terminals 20 and large terminals 22 are inserted in channels 40 and 42 respectively.

Once the terminals are inserted, the terminals encounter small and large primary locking fingers 44 and 46 which provide primary locking of the small and large terminals 20 and 22, respectively, in the terminal receiving channels. Primary locking fingers 44 and 46 extend into the receiving channels from front surfaces of rear chamber 16*b* above and below lock bar receiving cavity 38 into the front chamber 16*b*. When the small and large terminals 20 and 22 are inserted in the receiving channels, a nib 44*a* of the small locking finger 44 and another nib (not shown) snap into grooves 20*a* and 22*a* of the small and large terminals 20 and 22 to primarily lock the terminals in the housing. This action occurs for the terminals inserted above and below cavity 38 since cavity 38 extends below the top row and above the bottom row of locking fingers, and a single lock bar 18 locks in two rolls of terminals simultaneously.

Figure 4:
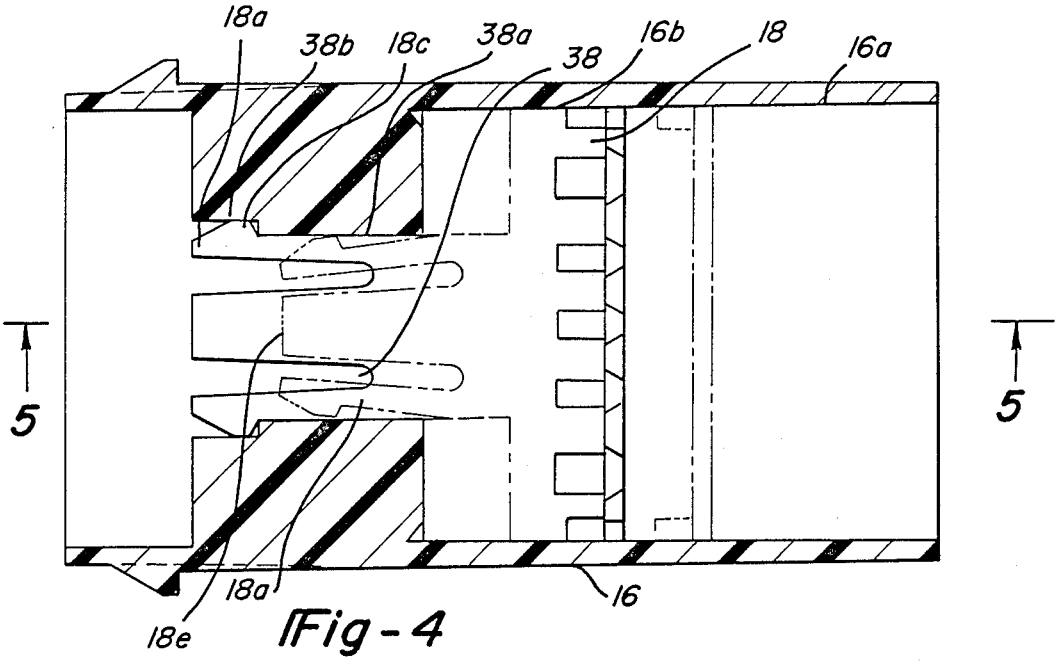
FIG. 4 is a sectioned top view of the in-line plug of FIG. 3 illustrative of the insertion and locking operation of the lock bar of this invention.

Turning now to FIGS. 2, 4, 5 and 6 which illustrate the insertion of lock bar 18 into housing 16, after both rows of terminals have been inserted into terminals receiving channels 40 and 42, lock bar 18 is inserted in cavity 38 to lock the primary locking fingers 44 and 46 in place in the grooves 20*a* and 22*a* respectively. As lock bar 18 is inserted into cavity 38, the side edges of the fingers 18*a* of lock bar 18 guide along front walls 38*a* of cavity 38. The pair fingers 18*a* of lock bar 18 flex inwardly as shown in FIG. 4 as fingers 18*a* glide over the walls 38*a*. When lock bar 18 is completely seated, the fingers 18*a* extend rearwardly beyond the rearward ends of the terminals and spring out against the walls 38*b* of cavity 38 such that nibs 18*b* of fingers 18*a* abut against the walls 38*b* and secure lock bar 18 within cavity 38.

With lock bar 18 completely inserted, the pin end of each of the terminals 20 and 22 are encircled by the upright struts 18*c* at the rear of lock bar 18 which have the concave-shaped distal ends that engage the under portion of the periphery of the upper terminals and the top portion of the periphery of the lower terminals and mate with the arch-shaped terminal receiving portion of channels 40 and 42 in a complementary fashion so as to prevent wobbly movement of the terminals when the cable assembly plug and socket are joined.

If it becomes necessary to disassemble a plug or socket, it is only necessary to insert a sharp pointed tool in the pair of removal ports 16*p* of the housing 16 and pry the lock bar 18 from cavity 38 with a backward motion. As the prying progresses, the fingers 18*a* of lock bar 18 will deflect causing the nibs 18*c* to slide out from walls 38*b* releasing lock bar 18 from housing 16. When lock bar 18 has been pried out sufficiently to be grasped, it may be completely pulled from cavity 38. The removal of lock bar 18 makes it possible to insert a removal tool against the fingers of terminals 20 and 22 to overcome the locking finger action of fingers 44 and 46 permitting the terminals to be withdrawn from the terminal receiving channels 40 and 42 respectively.

An alternate method for disassembly of the plug or socket can be illustrated by referring to FIG. 4. A third region of plug 12 at the end of the lock bar fingers 18*a* contains an end packing material (not shown). This packing material may easily be removed. Removal of the packing material exposes the ends of fingers 18*a*. The ends of the fingers 18*a* may be flexed inwardly by pressing against finger 18*e* to remove the nibs 18*b* from abutting against the walls 38*b*, thus unlocking the bar. Then the ends of the fingers 18*a* can be pushed so as to remove bar 18 from the cavity 38.

A similar operation occurs for removal of terminals in socket 14 as has been described for removing terminals in the plug 12. The channel construction along with the primary locking fingers and the lock bar 26 are substantially identical.

While the present invention has been disclosed in connection with the preferred embodiment thereof, it should be understood that there may be other embodiments which fall within the spirit and scope of the invention and that the invention is susceptible to modification, variation and change without departing from the proper scope or fair meaning of the following claims.

What is claimed is:

1. An environmentally sealed cable assembly for connecting two separate cable circuits using female terminals in a socket and male terminals in a plug;

wherein a pair of rows of male terminals are positioned in a plurality of arch-shaped terminal receiving channels disposed in a housing of the plug in a chosen manner;

wherein a pair of rows of female terminals are positioned in a plurality of arch-shaped terminal receiving channels disposed in a housing of the socket in a chosen manner;

wherein each of the plurality of female and male terminals has a circular groove at a chosen position along the body of the terminal for use in locking the terminal into the housing;

wherein each of the plurality of female and male terminals include a pair of crimping arms at a rear end for crimping a wire to the terminal;

wherein each of the plurality of channels disposed in the socket and plug housings has a locking keeper arranged therein which snaps into the circular groove of the terminal for providing primary locking of each terminal in each channel to prevent accidental retraction of the terminal during use;

wherein the plug housing is comprised of two molded chambers, a front undivided chamber for receiving the socket and a rear divided chamber in which the plurality of terminals are positioned;

wherein the socket housing is a single chamber structure having the plurality of channels extending substantially the length of the housing in which the plurality of socket terminals are positioned; said cable assembly comprising:

(a) a lock bar receiving cavity disposed between the pairs of rows of male terminal receiving channels within the interior of the plug, said lock bar receiving cavity not being open peripherally to the exterior of the plug so as to maintain environmental integrity;

(b) another lock bar receiving cavity disposed between the pairs of rows of the female terminal receiving channels within the interior of the socket, said other lock bar receiving cavity not being open peripherally to the exterior of the plug so as to maintain environmental integrity;

(c) a male terminal lock bar for insertion in said plug lock bar receiving cavity, locking each of the plurality of locking keepers in the circular grooves of each of the male terminals in the pair of rows of male terminals, said male terminal lock bar having a pair of outer, laterally directed, triangularly shaped, resilient material locking fingers and at least one rectangular shaped finger disposed between said pair of outer fingers, said outer fingers flexing inwardly upon entry into the receiving cavity between the first pair of side walls and then outwardly when a pair of nibs of the outer fingers contact the second pair of side walls, thus locking said lock bar within said receiving cavity, said fingers extending rearwardly beyond the rear ends of said terminals; and (d) a female terminal lock bar for insertion in said socket lock bar receiving cavity, locking each of the plurality of locking keepers in the circular grooves of each of the female terminals in the pair of rows of female terminals, said female terminal lock bar having a pair of outer, laterally directed, triangularly shaped, resilient material locking fingers and at least one rectangular shaped finger disposed between said pair of outer fingers, said outer fingers flexing inwardly upon entry into the receiving cavity between the first pair of side walls and then outwardly when a pair of nibs of the outer fingers contact the second pair of side walls, thus locking said lock bar within said receiving cavity, said fingers extending rearwardly beyond the rear ends of the terminals.

2. Assembly of claim 1 wherein said male and female terminal lock bars each have a pair of upright struts disposed in opposite directions at a terminating end of said bar so that a first said strut contacts terminals in the row above the respective said receiving cavity and a second said strut contacts terminals in the row below the respective said receiving cavity, said first strut having a series of concave-shaped distal ends that engage an under portion of the periphery of the terminals in the row above the respective said receiving cavity and said second strut having another series of concave-shaped distal ends that engage an upper portion of the periphery of the terminals in the row below the respective said receiving cavity.

3. Assembly of claim 2 wherein said distal ends mate with the arch-shaped terminal receiving channels in said plug and socket housings in a complementary fashion so as to prevent wobbly movement of the terminals when the cable assembly socket and plug are joined.

4. Assembly of claim 1 wherein an environmental seal is disposed about a front end of the housing of said socket such that when said socket and said plug are joined, a sealing occurs in the front chamber of the plug that opposes entry of environmental elements that might reach the terminals housed therewithin; and wherein end packing material is disposed at an end of said socket or plug housing to prevent entry of environmental elements around terminal wires.

5. Assembly of claim 3 wherein said plug and socket housings each contain a pair of removal ports for inserting a sharp pointed tool for prying said lock bars from said housings.

6. Assembly of claim 3 wherein said rectangular shaped finger of said male and female terminal lock bars has an end surface which may be pressed against in a direction opposite to insertion to deflect said outer fingers inwardly from said second pair of side walls of said receiving cavity permitting extraction of said lock bar from said cavity after removal of an end packing material to expose the end surface of said rectangular shaped finger.

* * * * *

UNITED STATES PATENT AND TRADEMARK OFFICE

CERTIFICATE OF CORRECTION

PATENT NO. : 4,950,182

DATED : Aug. 21, 1990

INVENTOR(S) : Thomas E. Zielinski, et al.

It is certified that error appears in the above-identified patent and that said Letters Patent is hereby corrected as shown below:

Column 1, line 26, change "removable" to read --removal--.

Figure 5:
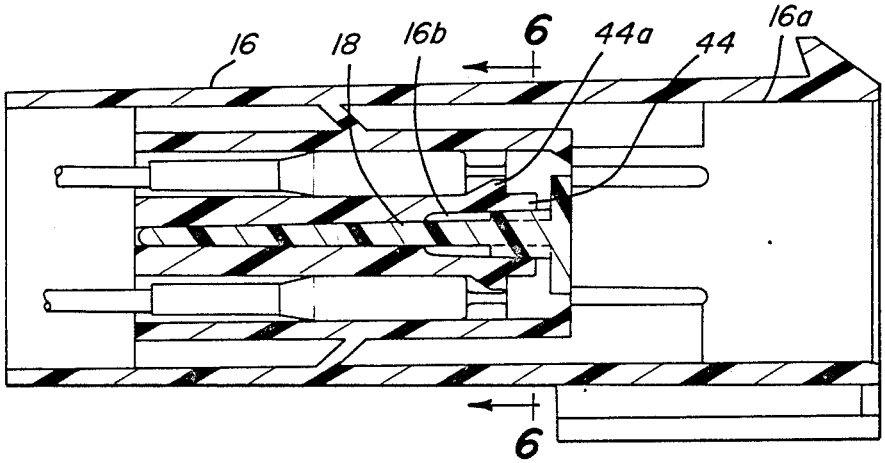
FIG. 5 is a cross-sectional view of the in-line plug of FIG. 4 taken along the lines 5—5 illustrative of the interaction of the secondary lock bar with the primary locking finger.

Column 3, line 15, after "18d", insert --of Fig. 3--;
line 15, after "26d", insert --of Fig. 2--;
line 24, after "18d", insert --of Fig. 3--;
line 24, after "26d", insert --of Fig. 2--;
line 40, after "42", insert --of Fig. 6--;
line 52, after "44", insert --of Fig. 5--;
line 53, after "22a", insert --of Fig. 2--;
line 56, after "38", insert --of Fig. 6--.

Column 4, line 5, change "18b" to read --18f--;
line 9, after "22", insert --of Fig. 2--;
line 15, after "42", insert --of Fig. 6--;
line 20, after "16", insert --of Fig. 4--;
line 23, change "18c" to read --18f--;
line 28, after "22", insert --of Fig. 6--;
line 39, change "18b" to read --18f--;
line 44, after "14", insert --of Fig. 2--.

UNITED STATES PATENT AND TRADEMARK OFFICE

CERTIFICATE OF CORRECTION

PATENT NO. : 4,950,182

DATED : Aug. 21, 1990

INVENTOR(S) : Thomas E. Zielinski et al

It is certified that error appears in the above-identified patent and that said Letters Patent is hereby corrected as shown below:

In The Drawing:

Fig. 4, change "18c" to read --18f--.

Signed and Sealed this

Twenty-first Day of April, 1992

*Attest:*

HARRY F. MANBECK, JR.

*Attesting Officer*

*Commissioner of Patents and Trademarks*